United States Patent [19]

Kaneko

[11] Patent Number: 4,531,050

[45] Date of Patent: Jul. 23, 1985

[54] TAPE COUNTER

[75] Inventor: Satoshi Kaneko, Yonezawa, Japan

[73] Assignee: Tamura Electric Works, Ltd., Tokyo, Japan

[21] Appl. No.: 313,271

[22] Filed: Oct. 21, 1981

[30] Foreign Application Priority Data

Oct. 25, 1980 [JP] Japan ..... 55-152416[U]
Mar. 31, 1981 [JP] Japan ..... 56-46834[U]

[51] Int. Cl.[3] ..... G06C 5/02; G06C 15/42

[52] U.S. Cl. ..... 235/1 D; 235/144 HC; 235/144 SS; 235/144 SP

[58] Field of Search ..... 235/1 R, 1 C, 1 D, 117 A, 235/144 R, 144 HC, 139 R, 95 R, 96

[56] References Cited

U.S. PATENT DOCUMENTS 3,648,028 3/1972 Hara et al. ..... 235/144 HC X
4,192,136 3/1980 Robinson ..... 235/139 R X

*Primary Examiner*—Benjamin R. Fuller

*Attorney, Agent, or Firm*—Blakely, Sokoloff, Taylor & Zafman

[57] ABSTRACT

A tape counter with the structure where a substantially U-shaped frame is provided with digit wheel engaging grooves vertically notched on both side plates thereof, a digit wheel shaft axially mounting digit wheels is fitted on both ends to said engaging grooves, a lens member is integrally formed on a cover assembled over the frame to magnify and display digits on the digit wheels, positioning projections are integrally formed on the internal surface of the cover on the center line of the lens member, the reading line of the digit wheels is aligned with the center line of the lens member by engaging the projections into the digit wheel shaft engaging grooves, a side play adjusting spring having a slit extending upward from the lower end thereof to allow the digit wheel shaft to pass therethrough is inserted between the side plates and the highest order digit wheel and the upper end of the side play adjusting spring is caught with the internal surface of the cover.

9 Claims, 8 Drawing Figures

TAPE COUNTER

BACKGROUND OF THE INVENTION

The present invention relates to a tape counter which is mounted on a tape recorder to count and display the amount of run of the tape.

A tape recorder is usually provided with a tape counter. Such tape counter generally comprises a substantially U-shaped frame including a bottom plate and a pair of upright side plates projected in a manner to oppose each other from both ends of said bottom plate, digit wheels and a driving gear thereof axially mounted on a digit wheel shaft in a freely rotatable fashion, the digit wheel shaft being supported between said side plates, a zero resetting bracket member which is rotatably supported on a supporting shaft arranged parallel to said digit wheel shaft and which further has a heart-shaped cam lever for depressing a heart-shaped cam formed on the side of the digit wheels, a rotation carry pinion interposed between digit wheels rotatably mounted on the supporting shaft on said zero resetting bracket member and a motion transmitting pinion interposed between the lowest order digit wheel and the driving gear, a push button member which rotates said zero resetting bracket member to have the heart-shaped cam lever depress the heat-shaped cam and which frees the meshing of the driving gear with the pinions, a rotary shaft rotatably inserted in a bearing shell formed at a corner of the frame bottom plate, a worm to be engaged with the driving gear fixed on the upper part of said rotary shaft, and a pulley fixed on the lower part of the rotary shaft and connected to the tape driving source via a belt. This type of tape counters may be exemplified by the one disclosed in U.S. Pat. No. 4,197,452. The tape counter disclosed in the above patent achieves rationalization in assembling process and reduction in costs through making all component elements with plastic materials in an integrated form. For example, the above counter adopts a structure where on the frame bottom plate is integrally projected a bearing plate having a shaft hole with an open upper end, and a pin shaft is integrally projected on both sides of the zero resetting bracket member, thereby materializing the so-called one-touch assembling of component members for a zero resetting bracket. In prior art the digit wheels are assembled by inserting a digit wheel shaft into a frame through a hole bored on a side plate, mounting consecutively each digit wheel and a driving gear thereto and forcing an shaft end into the shaft hole on the side plate of the other side. Such assembling operation is quite troublesome and needs skill and experience. Further, in prior art those components elements such as digit wheels and pinions are molded with synthetic resin and, therefore, susceptible to dimentional changes by environmental changes, causing frequent disengagement. In order to prevent such disengagement, a coil spring to adjust the side play or the movement on the digit wheels in the axial direction is incorporated between the highest order digit wheel and the frame side plate. Since this coil spring is extremely small in size and easy to warp, the step to assemble this coil spring onto the digit wheel shaft presents a formidable difficulty. The tape counter disclosed in the above mentioned U.S. Pat. is not required to magnify the digits on the digit wheels for display because the size thereof is relatively large. However, as the size of a tape recorder has become smaller, the size of a tape counter has been minimized, necessitating a means to magnify digits on digit wheels for display. The tape recorder disclosed in U.S. Pat. No. 4,221,327 incorporates such structure. The tape counter is provided with a cover molded with transparent synthetic resin which can be assembled over a frame having a lens member integrally formed therewith. In a cover of this type which is assembled with a frame by engaging dowels projected on both sides with small holes bored on side plates, the position of the cover is determined by the side plates, presenting heretofore difficulties in aligning the center line of the lens mechanism with the reading line of the digit wheels in manufacturing process. The disalignment of the center line of the lens member from the reading line causes distortion on digits and further the light reflected on expanded portion makes the displayed digits on the counter hard to read. As the size of mechanism is getting smaller and smaller, larger magnification becomes necessary and a greater radius of curvature required, intensifying above mentioned defects of the prior art.

SUMMARY OF THE PRESENT INVENTION

Accordingly it is a object of this invention to provide small size tape counter and aims at accurately aligning the reading line of the digit wheels with the center line of the lens member to obviate such defects as distortion in digits or difficulties in reading etc.

Another object of the present invention is to provide a tape counter capable of assembling the side play adjusting means through an extremely simple process and thereby to manufacture a tape counter at a lower cost.

Still another object of the present invention is to provide a tape counter with a cover which is integrally formed with a lens member for magnifying digits on digit wheels for display purpose and which can be securely assembled with the frame through an extremely simple technique.

Yet another object of the present invention is to provide a tape counter which is adopted to control the movements of the worm in axial direction through a simple structure.

Another object of the present invention is to provide a tape counter made to align the mounting position on the tape recorder with the reading line of digit wheels and with the center line of the lens portion.

A further object of the present invention is to provide a tape counter which is structure to maintain the force of the plate spring for controlling the side play on the digit wheels at a constant value.

Other objects of the present invention will be clearly understood from the explanation and description of preferred embodiments of the invention hereinafter.

The above objects of the present invention are achieved by a tape counter of the structure comprising a substantially U-shaped frame of synthetic resin including a bottom plate and a pair of upright side plates projecting opposedly from the both sides of the bottom plate and vertical digit wheel shaft engaging grooves extending on the side plates from the uppermost end to align axial lines to each other, and the digit wheels axially mounted on the digit wheel shaft engaged with said engaging groove at both ends, which is adopted that, when a cover forming integrally the lens member for magnifying digits on the digit wheels is assembled in the upper part of a frame, positioning projections formed on the internal face of the cover on the center line of the lens member come to mesh with said engaging grooves, thereby aligning the reading line for the digit wheels with the center line of the lens member. The tape counter according to the present invention further includes a side play adjusting spring of a crank like contour having a slit in a width sufficient to allow the digit wheel shaft to penetrate therethrough and in a length extending the lower end to almost central position, which is inserted between the highest order digit wheel and the side plate. The end of the side play adjusting spring is caught by the internal face of the cover.

BRIEF DESCRIPTIONS OF THE DRAWINGS

DESCRIPTION OF THE PREFERRED EMBODIMENTS

Figure 1:
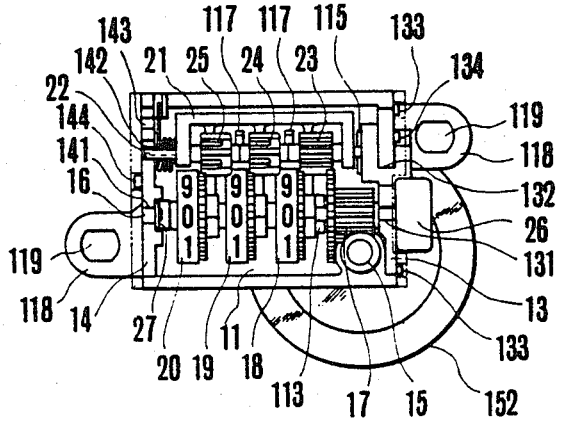
FIG. 1 is a front view of a tape counter according to the present invention when the cover is taken off.
Figure 2:
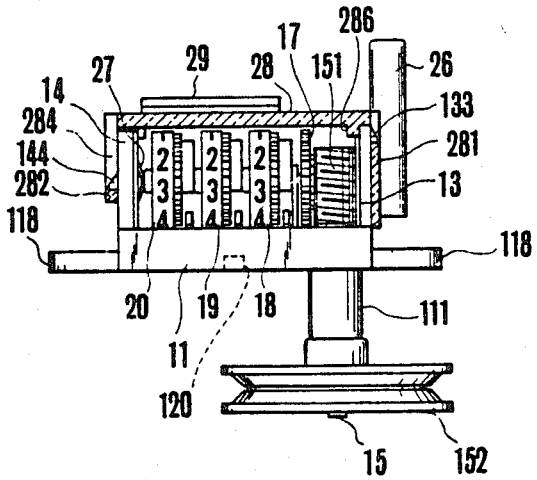
FIG. 2 is a bottom view when the cover is cross sectioned.
Figure 3:
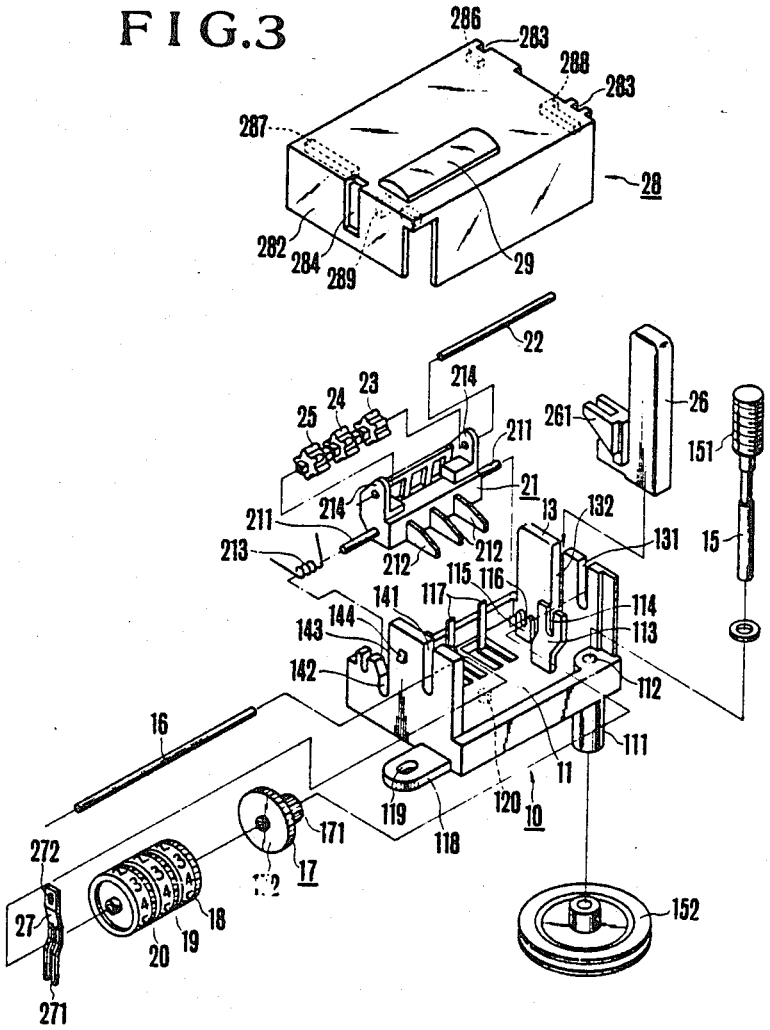
FIG. 3 is an exploded perspective view of the tape counter according to the present invention to show all component elements.

In the drawings reference numeral 10 denotes a frame molded of synthetic resin which comprises a bottom plate 11 and a pair of upright side plates 13, 14 projecting opposedly in parallel from the both sides of the bottom plate, defining the outer contour in a substantially U-letter shape. As shown in FIG. 3, on the side of the side plate 13 of the bottom plate 11 from the frontal portion toward rear portion there are integrally formed a bearing shell 111 having a shaft hole 112, a plate-shaped spacer 113 with a slit 114 vertically extending from the tip end, and a plate-shaped bearing 115 having a shaft hole 116 open at the upper portion thereof. Further in the rear portion L-shaped pinion members 117 are cut and bent upright in a row in a longitudinal direction. Bracket members 118 are integrally projected from the front portion of the side plate 14 as well as from the rear portion of the side plate 13 of the bottom plate 11, the bracket member 118 being provided with a mounting hole 119 respectively for mounting the counter on a tape recorder. A blind hole 120 is bored on the undersurface of the bottom plate 11. The blind hole 120 is positioned at a position aligned with the reading line L of the digit wheels as described hereinafter so as to engage with a dowel on the mounting portion of the tape recorder for positioning the counter. In the case where small holes are provided in the mounting portion, dowels may be projected on the bottom plate 11 of the frame.

The side plate 13 is provided with two vertical grooves extending from upper end thereof. The front groove 131 is for engaging the digit wheel shaft and is aligned axially with the slit 114 of the said spacer 113 and is shaped substantially semicircular at the bottom thereof. The rear groove 132 is for guiding the push button. A stopper 133 is projected near the upper ends on both sides of the side plate 13 while a push button stopper 134 is provided on rear upper end of the push button guiding groove 132.

The side plate 14 is provided with a digit wheel shaft engaging groove 141 extending vertically and axially aligned with said digit wheel engaging groove 131. The digit wheel engaging groove 141 is also shaped semicircular at the bottom thereof. Behind of the side plate 14 which is notched and reduced in height there is provided a zero resetting bracket engaging groove 142 in vertical direction and aligned axially with the shaft hole 116 of said bearing 115. The bottom of the engaging groove 142 is also shaped semicircular. On the outer side frace of the side plate 14 from which engaging grooves 141 and 142 are notched is projected a wedge-formed stopper 144. A groove for engaging slide play adjusting spring 145 is bored on the internal face of the side plate 14 along the digit wheel shaft engaging groove 141.

A rotary shaft 15 is inserted into the shaft hole 112 of the bearing shell 111 in a freely rotatable fashion. A worm 151 is integrally formed in the upper part of the rotary shaft 15 and a pulley 152 is fixed in the lower part thereof which extends through the bearing shell 111 toward the lower part of the frame 10, the pulley 152 being to be connected to a driving source of the tape recorder via a belt.

Figure 5:
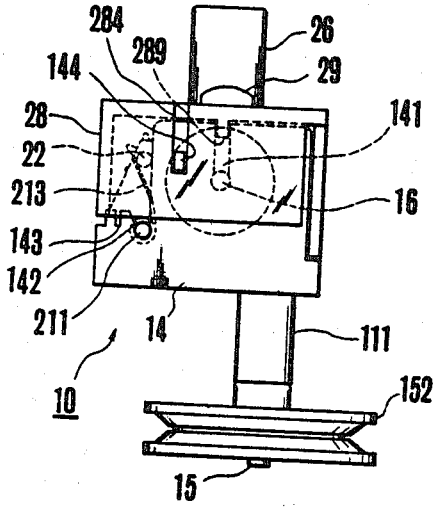
FIG. 5 is a left side view of the tape counter.

A digit wheel shaft 16 is supported between the side plates 13 and 14 in a manner to insertedly engage both ends thereof from above with the engaging grooves 131 and 141. The digit wheel shaft 16 of the length substantially equivalent to the spacing between the side plates 13 and 14 plus the thickness thereof penetrates slit 114 of the spacer 113. The shaft mounts a ridged gear 17 of synthetic resin at a position between the spacer 113 and the side plate 13 and digit wheels 18, 19, 20 of synthetic resin in a manner freely rotatable between the spacer 113 and the side plate 14. As well known, heart-shaped cams and gears are integrally provided on the side face of the side plate 13 while a segment gear for carrying rotation is provided on a part of the periphery thereof. Digits 0 to 9 are printed on the periphery face. The ridged gear 17 axially mounted on the supporting shaft 16 is engaged with said worm 151 at the gear of smaller diameter 171 thereof. A zero resetting bracket 21 of synthetic resin is supported by the side plate 14 and the bearing 115. A pin shaft 211 is integrally projected from the zero resetting bracket 21 on both sides. The zero resetting bracket 21 is rotatably supported by inserting the pin shaft 211 into the engaging groove 142 of the side plate 14 and the bearing 115 for engagement and has a heart-shaped cam lever 212 provided upright to correspond with the heart-shaped cam on the digit wheels. The zero resetting bracket 21 is energized in the clockwise direction shown in FIG. 5 by a tortion spring 213 mounted on the pin shaft 211. A pair of arms 214,214, are bent upright opposedly in parallel to each other from the base on both sides thereof and a pinion shaft 22 is supported between the arms 214,214. On end of the pinion shaft 22 extends close to the inner surface of the side plate 13 while the other end thereof abuts the ridged portion 143 of the side plate 14, thereby defining the axial space from the digit wheel shaft 16. The pinion shaft 22 axially mounts a motion transmitting pinion 23 and carry pinions 24 and 25 in a rotatable fashion. The motion transmitting pinion 23 is interposed between the larger diameter gear 172 of the ridged gear 17 and the gear of the digit wheels to mesh therewith while the carry pinions 24 and 25 are interposed respectively between digit wheels 18, 19 and 20. Each pinion is molded with synthetic resin.

Figure 4:
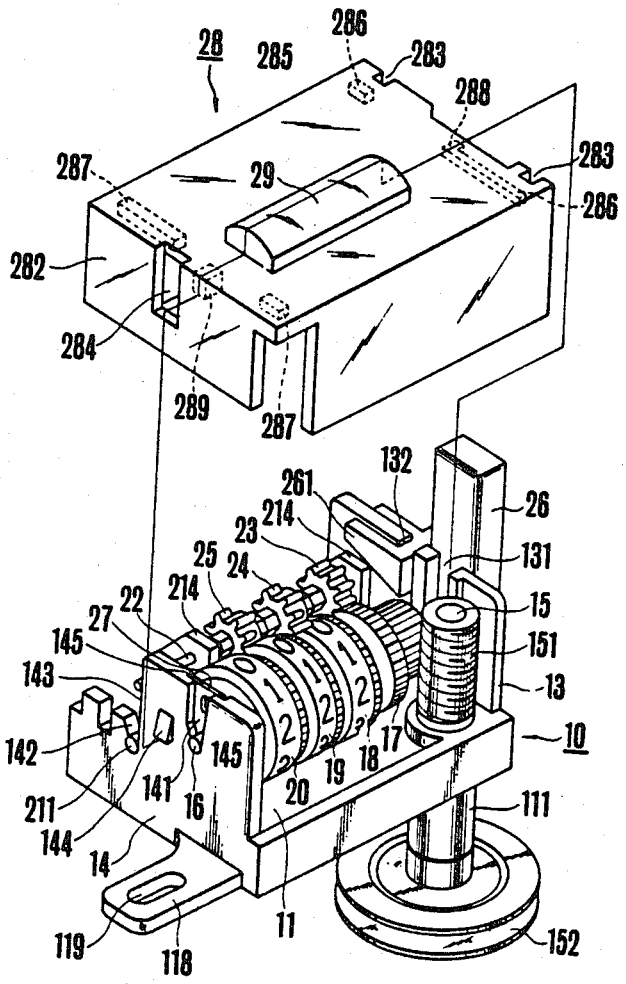
FIG. 4 is a perspective view to show the state where the cover is taken out.

When the tape recorder is started, the revolution is transmitted to the pulley 152 to rotate the worm 151 via the rotary shaft 15 and to drive the ridged gear 17. The revolution of the ridged gear 17 is transmitted to digit wheel 18 through the carry pinion 23 so that as the digit wheel 18 rotates once, the carry segment gear rotates the carry pinion 24 by a predetermined angle to advance the digit wheel 19 by one step. The same operation is repeated to count and display the amount of the run of the tape on the digit wheels 18, 19 and 20 in a manner similar to the prior art. The digits displayed on the digit wheels 18, 19, 20 are read out from above the upper position of the frame 10. The axis on the apexes of the digit wheels indicated in FIG. 4 is defined as the reading line.

For starting the next operation of the tape recorder, the display on the digit wheels is reset to zero by pushing of a push button 26. The push button 26 of synthetic resin is stopped on a guiding groove 132 of the side plate 13 with a stopper 134 in a manner freely movable vertically and has a triangle cam 261 positioned inside of the side plate 13 to engage with one end of the pinion shaft 22. When the push button 26 is pushed, the pinion shaft 22 is pushed counterclockwise as shown FIG. 3 through the triangle cam 261 while the zero resetting bracket 21 is rotated counterclockwise against the force of the tortion spring 213. The revolution of the zero resetting bracket 21 frees the meshing among the ridged gear 17, the digit wheels 18, 19, 20, the motion transmitting pinion 23 and the carry pinions 24 and 25 so as to restore the digit wheels 18, 19 and 20 to the freely rotatable condition and the heart-shaped cam lever 212 depresses the heart-shaped cam to reset the digits on the wheels to zero.

As described hereinabove, the frame 10, the ridged gear 17, the digit wheels 18, 19, 20, the zero reset bracket 21 and the pinions 23, 24, 25 are molded with synthetic resin and susceptible to the changes in dimensions and shapes due to such environmental conditions as temperature and humidity. A suitable spacing in the axial direction is required between the digit wheels and pinions. The spacing generally known as a side play is subject to fluctuation due to the above mentioned environmental changes, jeopardizing the meshing between the digit wheels and pinions and further making normal driving impossible. To prevent such inconvenience a side play adjusting spring 27 is interposed between the side plate 14 and the highest digit wheel 20 to energize the digit wheels toward the side plate 13. The side play adjusting spring 27 is made of resilient metal material by press working to assume substantially a crank like form expanded at the center thereof toward the side plate 13. The whole length thereof is defined to be slightly shorter than the spacing between a cover 28 which will be described hereinafter and the bottom plate 11 of the frame 10 while the width thereof is defined as substantially identical with the width of the engaging groove 145 of the side plate 14. The adjusting spring 27 forks to form a slit 271 from the lower end up until about the center thereof and a through hole 272 is bored above the slit 271. The width of the slit 271 is determined to allow the digit wheel shaft 16 to penetrate therethrough. The through hole 272 is provided in order to prevent the forked adjusting spring 27 from causing the tension which is uneven between the upper half and the lower half parts thereof when assembled.

What should be noted is the engaging groove 145 of the side plate 14. With the provision of the engaging groove 145 cut inside of the side plate 14, the spacing between the side plate 14 and the highest order digit wheel 20 is defined with an increase by the depth of the groove 145 and the side play adjusting spring 27 inserted into the engaging groove 145 can have the bending angle increased by the spacing, thereby stabilizing the tension.

The side play adjusting spring 27 is inserted into the engaging groove 145 from above the side plate 14 for assembling and, since the digit wheel shaft 16 is made to pass through the slit 271, the adjusting spring 27 is interposed under compression between the side plate 14 and the highest order digit wheel 20. Since the side play adjusting spring 27 is restricted at the both ends thereof with the groove walls of the engaging groove 145, rotational movement thereof is prevented.

The side play adjusting spring 27 is stopped at the upper end thereof with the cover 28 which tops the frame 10. The cover 28 is substantially defined as a box like contour with an open lower end and the right side is made of transparent synthetic resin. The two side plates 281 and 282 of the cover 28 are provided with engaging grooves 283 and 284 to correspond to stoppers 133 and 144 of the frame side plates 13, 14. The catch projections 286 and 287 are formed in parallel to the side plates on the inside face of the display 285 at the position spaced apart from the side plates 281 and 282 by the distance equal to the thickness of the frame side plates 13 and 14. The cover 28 is tightly assembled to the frame 10 by engaging the stoppers 133 and 144 with the engaging grooves 283, 284, by interposing the side plate 13 between the side plate 281 and the catch projection 286 and by interposing the side plate 14 between the side plate 282 and the catch projection 287. A convex lens 29 is formed integrally with the display 285 and the surface of the display 285 except for the lens 29 is satinfinished. The positioning projections 288, 289 are projected integrally inside on the both sides of the cover 28 which is positioned at the center line M of the lens 29. The cross sectional dimension of the positioning projections 288, 289 is almost identical with the opening contours of the frame side plates 13, 14 and the digit wheel engaging grooves 131, 132 so as to fit in the grooves 131, 132 when the cover 28 is placed over the frame 10. Since the positioning projections 288, 289 are provided on the center line M of the lens 29 and the digit wheel shaft 16 is fitted into and supported by the engaging grooves 131, 132 at both ends thereof, the reading line L of the digit wheels is made to align with the center line M of the lens member 29. The alignment of the reading line L with the center line M makes the digits on the digit wheels 18, 19 and 20 accurately magnified and displayed without undersirable distortion or warp through the lens 29. Since the blind hole 120 of the frame bottom plate 11 is also aligned with the reading line L, the alignment of the counter with the tape recorder is achieved accurately. The side play adjusting spring 27 inserted into the engaging groove 145 is prevented from moving upward to disengage since it extends adjacent to the underface of the positioning projection 289.

As described hereinabove, since the length of the side play adjusting spring 27 is determined as slightly shorter than the spacing between the bottom plate 11 of the frame 10 and the cover 28, the both ends are left unrestricted and the bending angle is not forced to change when the frame 10 is covered with the cover 28 but is kept with a constant tension to force the group of the digit wheels toward the side plate 13, thereby controlling the side play thereof.

Figure 6:
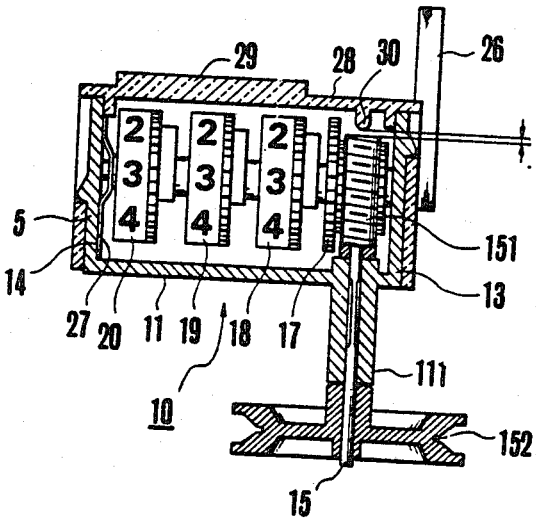
FIG. 6 is a vertical cross sectional view to explain other important elements.
Figure 7:
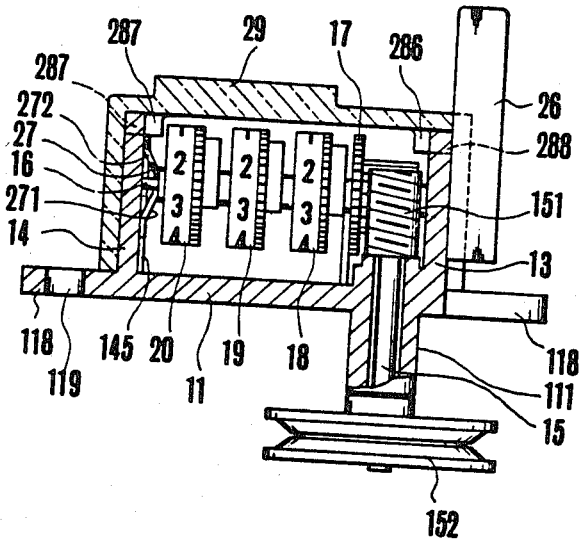
FIG. 7 is a schematic vertical cross section to show other important element.

FIG. 6 is a simplified view to explain the other roles of the cover 28 with reference numerals identical with those indicated for the above structures. A restrictive projection 20 may be provided on the internal face of the display 285 of the cover 28 to top the frame 10 in order to control the axial movement of the rotary shaft 15 mounted within the bearing shell 111. As explained in detail hereinabove, component elements of the tape counter are frequently molded with synthetic resin and the bearing shell 111 is also susceptible to dimensional changes caused by environmental fluctuations. In order to allow such changes, the spacing between the worm 151 and the pulley 152 is determined slightly larger than the axial length of the bearing shell 111. In prior art, the position to fix the pulley 152 on the rotary shaft 15 used to be adjusted by such instruments as jigs but the fixing operation was troublesome and required considerable skill. Unless the adjustment is correctly conducted, the vertical movement of the worm 151 becomes large to cause irregular lateral or rotary movements of the ridged gear 17, whereby inconveniently generating noises or digit disalignment on digit wheels. In the present invention, since the axial movement of the worm 151 is controlled with the restrictive projection 20, the above mentioned inconvenience can be obviated.

Figure 8:
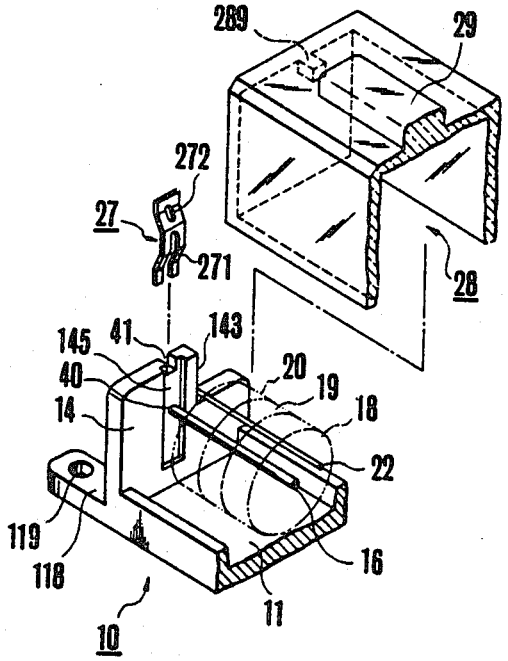
FIG. 8 is a perspective view to show important elements corresponding to the elements shown in FIG. 7.

The device according to the present invention can be exploded as in the embodiment shown in FIG. 8 where the digit wheel shaft 16 is at the ends thereof fitted into the shaft hole 40 bored on the frame side plate 14 to be supported between the side plates. A vertical engaging groove 145 is notched on the internal surface of the side plate 14 to encircle the shaft hole 40. A notched groove 41 is formed on the upper part of the engaging groove 145 at a position on an extension linear line from the shaft hole 40. Therefore, the positioning projection 289 of the cover 28 topped upon the frame 10 comes to be engaged with the notched groove 41 to align the reading line of the digit wheels with the center line of the lens member 29.

What is claimed is:

1. A tape counter comprising a substantially U-shaped frame of synthetic resin including a bottom plate and a pair of upright side plates in parallel to each other at opposing ends of said bottom plate, each side plate being notched at the upper end thereof by a digit wheel shaft engaging groove in a vertical direction on the same axial line, digit wheels axially mounted in a freely rotatable fashion on a digit wheel supporting shaft which is supported between the frame side plates with both ends fitted in the engaging grooves, and a cover assembled over the frame having an integrally formed lens member to magnify and display the digits on the digit wheels, said cover being provided with a pair of positioning projections integrally formed on the internal surface thereof, and said positioning projections being engaged with said engaging grooves so as to align the center line of the lens member with the reading line of the digit wheels.

2. The tape counter according to claim 1 which further includes a small hole or a dowel to fit in a dowel or a small hole bored on a mounting portion of the tape recorder which is to incorporate the counter on the outer side surface of the bottom plate corresponding to the reading line of the digit wheels.

3. The tape counter according to claim 1 which further includes wedge-shaped fitting projections on outer side surfaces of the side plates, wherein the cover is provided with a vertical groove corresponding to said engaging projections on side surfaces thereof and with catch projections spaced apart from the side walls by the thickness of the frame side plates on the internal surface of the cover, and said engaging projections are engaged with the engaging grooves while the side walls and the catch projections sandwich the frame side plate on the upper end thereof to assemble the frame and the cover.

4. The tape counter according to claim 1 which further includes a worm on an upper part of a rotary shaft rotatably mounted within a bearing shell formed at a corner of the bottom plate, a pulley on the lower part of the rotary shaft to receive the revolution transmission from a tape driving source and projections integrally formed on the internal side of the cover corresponding to the upper end of the worm, thereby restricting axial movements of the worm.

5. The tape counter according to claim 1 which further includes a side play adjusting spring having a slit extending upward from the lower end thereof in a width sufficient to allow the digit wheel shaft to pass therethrough, which is adopted to be interposed between the frame side plate and the highest order digit wheel in a manner to make the digit wheel shaft penetrate said slit in order to control the side play with said side play adjusting spring and to stop the upper end of the inserted side play adjusting spring with the internal surface of the cover.

6. A tape counter comprising a substantially U-shaped frame including a bottom plate and a pair of upright side plates in parallel to each other at opposing ends of said bottom plates, each side plate being bored to form a shaft hole for digit wheels with aligned axis and being notched to form a positioning groove on the upper end thereof above said shaft hole, digit wheels axially mounted in a freely rotatable fashion on a digit wheel supporting shaft which is supported between the frame side plates with both ends fitted in said shaft holes, and a cover assembled over the frame having an integrally formed lens member to magnify and display the digits on the digit wheels, a pair of positioning projections being provided integrally on the internal surface of the cover on the center line of the lens member, whereby the center line of the lens member is aligned with the reading line of the digit wheels by engaging said positioning projections with the positioning grooves.

7. A tape counter comprising a substantially U-shaped frame including a bottom plate and a pair of upright side plates in parallel to each other at opposing ends of said bottom plate, one of the side plates being bored to form a vertical engaging groove corresponding to the position of the digit wheel supporting part, digit wheels rotatably mounted on the digit wheel shaft supported between the side plates, a cover assembled over the frame and integrally forming a lens member for magnifying and displaying digits on the digit wheels, and a side play adjusting spring of a substantially crank shape of a width substantially equivalent to that of the engaging groove of the frame side plate which is provided with a slit extending upward from the lower end thereof in a width sufficient to allow the digit wheel shaft to pass therethrough, wherein the side play adjusting spring is inserted into the engaging groove by fitting the digit wheel shaft into the slit to be interposed between the side plate and the highest order digit wheel so that the digit wheels are energized toward the other side plate for controlling the side play of the digit wheels and the inserted side play adjusting spring is caught at the upper end thereof by the internal surface of the cover for preventing disengagement thereof.

8. The tape counter according to claim 7 wherein the side play adjusting spring which is interposed between the frame side plate and the digit wheels to energize the digit wheels toward the other side plate for controlling the side play of the digit wheels has a length slightly smaller than the spacing between the frame bottom plate and the cover internal surface opposing thereto, and the distance between the upper end of the slit extending upward from the lower end of the spring to almost the center thereof and the uppermost end of the spring is defined as to be slightly smaller than the spacing between the cover internal surface and the digit wheel shaft.

9. The tape counter according to claim 7 wherein the side play adjusting spring interposed between the frame side plate and the highest order digit wheel to energize the digit wheels toward the other side plate for controlling the side play of the digit wheels has a tension adjusting through hole positioned above the slit extending upward from the lower end to almost the center thereof.

* * * * *

UNITED STATES PATENT AND TRADEMARK OFFICE

CERTIFICATE OF CORRECTION

PATENT NO. : 4,531,050

DATED : Jul. 23, 1985

INVENTOR(S) : Taneko

It is certified that error appears in the above-identified patent and that said Letters Patent is hereby corrected as shown below:

| COLUMN | LINE | DESCRIPTION |
|---|---|---|
| 1 | 27 | Please delete "heat-shaped" and insert --heart-shaped--. |
| 3 | 1 | Please delete "for" and insert --of--. |
| 4 | 13 | Please delete "frace" and insert --face--. |

Signed and Sealed this

*Fifteenth* Day of *July 1986*

[SEAL]

*Attest:*

DONALD J. QUIGG

*Attesting Officer*

*Commissioner of Patents and Trademarks*